US011976536B2

(12) United States Patent
Al-Mousa

(10) Patent No.: US 11,976,536 B2
(45) Date of Patent: May 7, 2024

(54) FLARING BOOM KIT FOR COLLECTING SPILLS DURING DRILLING AND WORKOVER FLARING OPERATIONS

(71) Applicant: SAUDI ARABIAN OIL COMPANY, Dhahran (SA)

(72) Inventor: Ahmed Abdulaziz Al-Mousa, Doha (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 376 days.

(21) Appl. No.: 17/382,979

(22) Filed: Jul. 22, 2021

(65) Prior Publication Data

US 2023/0022592 A1 Jan. 26, 2023

(51) Int. Cl.
*E21B 41/00* (2006.01)
*F23G 7/08* (2006.01)

(52) U.S. Cl.
CPC ..... *E21B 41/0071* (2013.01); *F23G 7/085* (2013.01); *F23G 2209/102* (2013.01)

(58) Field of Classification Search
CPC ..... F23G 7/085; E21B 41/0071
USPC ..... 431/202
See application file for complete search history.

(56) References Cited

U.S. PATENT DOCUMENTS

| | | | | |
|---|---|---|---|---|
| 2,068,332 | A | 1/1937 | Kneisley | |
| 2,531,920 | A | 11/1950 | Martha | |
| 6,164,625 | A * | 12/2000 | Shockley | B66C 23/48 254/8 B |
| 2021/0003280 | A1 | 1/2021 | Umair et al. | |
| 2021/0123308 | A1* | 4/2021 | Holtby | E21B 21/01 |
| 2022/0136197 | A1* | 5/2022 | Elgammal | E02B 15/0835 431/5 |

FOREIGN PATENT DOCUMENTS

| | | | |
|---|---|---|---|
| CN | 204274326 | U | 4/2015 |
| KR | 20170050280 | A | 5/2017 |

* cited by examiner

*Primary Examiner* — Vivek K Shirsat
(74) *Attorney, Agent, or Firm* — Osha Bergman Watanabe & Burton LLP

(57) ABSTRACT

A flaring boom assembly for a flaring system of a rig is disclosed. The flaring boom assembly includes a tray device comprising an open top, a slanted bottom, and an outlet, and a telescoping mechanism mechanically coupled to the tray device and configured to adjust a relative position of the tray device with respect to a burning head of the flaring system based on a flaring intensity of the flaring system. The spills of the flaring system fall through the open top onto the slanted bottom and move along the slanted bottom toward the outlet based on a gravitational force.

12 Claims, 5 Drawing Sheets

FLARING BOOM KIT FOR COLLECTING SPILLS DURING DRILLING AND WORKOVER FLARING OPERATIONS

BACKGROUND

In the oil and gas industry, flaring may be performed while completing drilling or workover of wells. It is a method and practice of disposing unwanted amount of hydrocarbon (e.g., oil or natural gas) associated with oil production. Faring often have a large negative impact on the environment.

SUMMARY

In general, in one aspect, the invention relates to a flaring boom assembly for a flaring system of a rig. The flaring boom assembly includes a tray device comprising an open top, a slanted bottom, and an outlet, and a telescoping mechanism mechanically coupled to the tray device and configured to adjust a relative position of the tray device with respect to a burning head of the flaring system based on a flaring intensity of the flaring system, wherein spills of the flaring system fall through the open top onto the slanted bottom and move along the slanted bottom toward the outlet based on a gravitational force.

In general, in one aspect, the invention relates to a system that includes a rig, a flaring system of the rig, and a flaring boom assembly. The flaring boom assembly includes a tray device comprising an open top, a slanted bottom, and an outlet, and a telescoping mechanism mechanically coupled to the tray device and configured to adjust a relative position of the tray device with respect to a burning head of the flaring system based on a flaring intensity of the flaring system, wherein spills of the flaring system fall through the open top onto the slanted bottom and move along the slanted bottom toward the outlet based on a gravitational force.

In general, in one aspect, the invention relates to a tray device that includes an open top, a slanted bottom, and an outlet, wherein the tray device is configured to allow spills of a flaring system to fall through the open top onto the slanted bottom and move along the slanted bottom toward the outlet based on a gravitational force.

Other aspects and advantages will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Embodiments of this disclosure provide a flaring boom kit for a flaring system in a land rig and/or an offshore rig. In one or more embodiments of the invention, the flaring boom kit may be configured in a rig move mode configuration for mechanical stability and protection during rig movement. In addition, the flaring boom kit may be configured in a disposable layout configuration in order to safely dispose the spills that can harm the environment.

Figure 1:
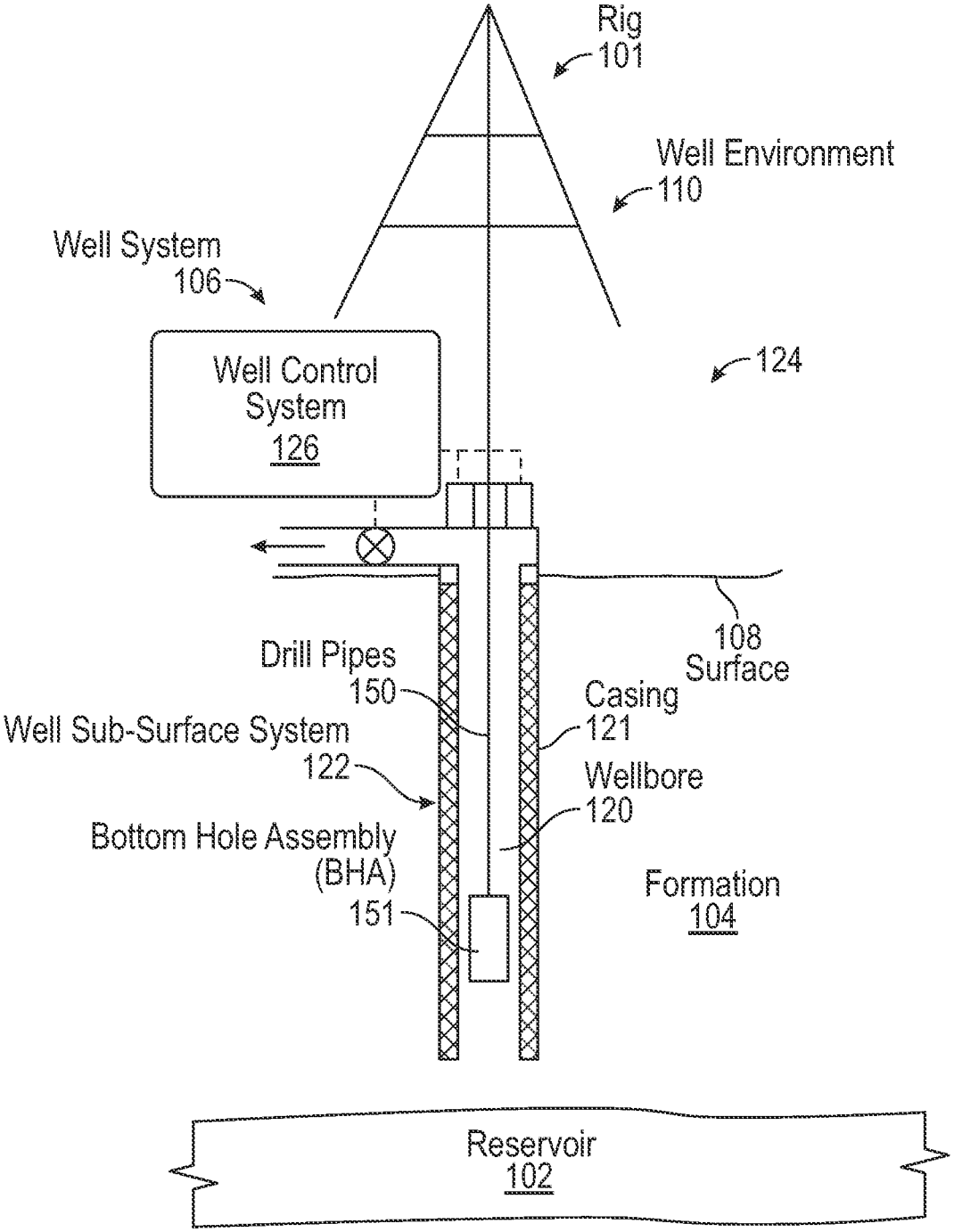
FIG. 1 shows a well environment in accordance with one or more embodiments.

FIG. 1 shows a system schematic diagram in accordance with one or more embodiments. In one or more embodiments, one or more of the modules and/or elements shown in FIG. 1 may be omitted, repeated, combined and/or substituted. Accordingly, embodiments disclosed herein should not be considered limited to the specific arrangements of modules and/or elements shown in FIG. 1.

As shown in FIG. 1, a well environment (100) includes a subterranean formation ("formation") (104) and a well system (106). The formation (104) may include a porous or fractured rock formation that resides underground, beneath the earth's surface ("surface") (108). The formation (104) may include different layers of rock having varying characteristics, such as varying degrees of permeability, porosity, capillary pressure, and resistivity. In the case of the well system (106) being a hydrocarbon well, the formation (104) may include a hydrocarbon-bearing reservoir (102). In the case of the well system (106) being operated as a production well, the well system (106) may facilitate the extraction of hydrocarbons (or "production") from the reservoir (102).

In some embodiments disclosed herein, the well system (106) includes a rig (101), a wellbore (120) with a casing (121), a well sub-surface system (122), a well surface system (124), and a well control system ("control system") (126). The well control system (126) may control various operations of the well system (106), such as well production operations, well drilling operation, well completion operations, well maintenance operations, and reservoir monitoring, assessment and development operations. For example, the well maintenance operations may include the workover of the wellbore (120).

The rig (101) is the machine used to drill a borehole to form the wellbore (120). Major components of the rig (101) include the drilling fluid tanks, the drilling fluid pumps (e.g., rig mixing pumps), the derrick or mast, the draw works, the rotary table or top drive, the drill string, the power generation equipment and auxiliary equipment. The work area of the rig (101) for the drilling crew is referred to as the rig floor. The rig (101) may include a flaring system and associated flaring boom kit to performed flaring during the well drilling operation or the well maintenance operation. Example details of the flaring system and associated flaring boom kit are described in reference to FIGS. 2-5 below.

The wellbore (120) includes a bored hole (i.e., borehole) that extends from the surface (108) towards a target zone of the formation (104), such as the reservoir (102). An upper end of the wellbore (120), terminating at or near the surface (108), may be referred to as the "up-hole" end of the wellbore (120), and a lower end of the wellbore, terminating in the formation (104), may be referred to as the "downhole" end of the wellbore (120). The wellbore (120) may facilitate the circulation of drilling fluids during drilling operations for the wellbore (120) to extend towards the target zone of the formation (104) (e.g., the reservoir (102)), facilitate the flow of hydrocarbon production (e.g., oil and gas) from the reservoir (102) to the surface (108) during production operations, facilitate the injection of substances (e.g., water) into the hydrocarbon-bearing formation (104) or the reservoir (102) during injection operations, or facilitate the communication of monitoring devices (e.g., logging tools) lowered into the formation (104) or the reservoir (102) during monitoring operations.

In some embodiments, the well system (106) is provided with a bottom hole assembly (BHA) (151) attached to drill pipes (150) to suspend into the wellbore (120) for performing the well drilling operation. The bottom hole assembly (BHA) is the lowest part of a drill string and includes the drill bit, drill collar, stabilizer, mud motor, etc.

Figure 2:
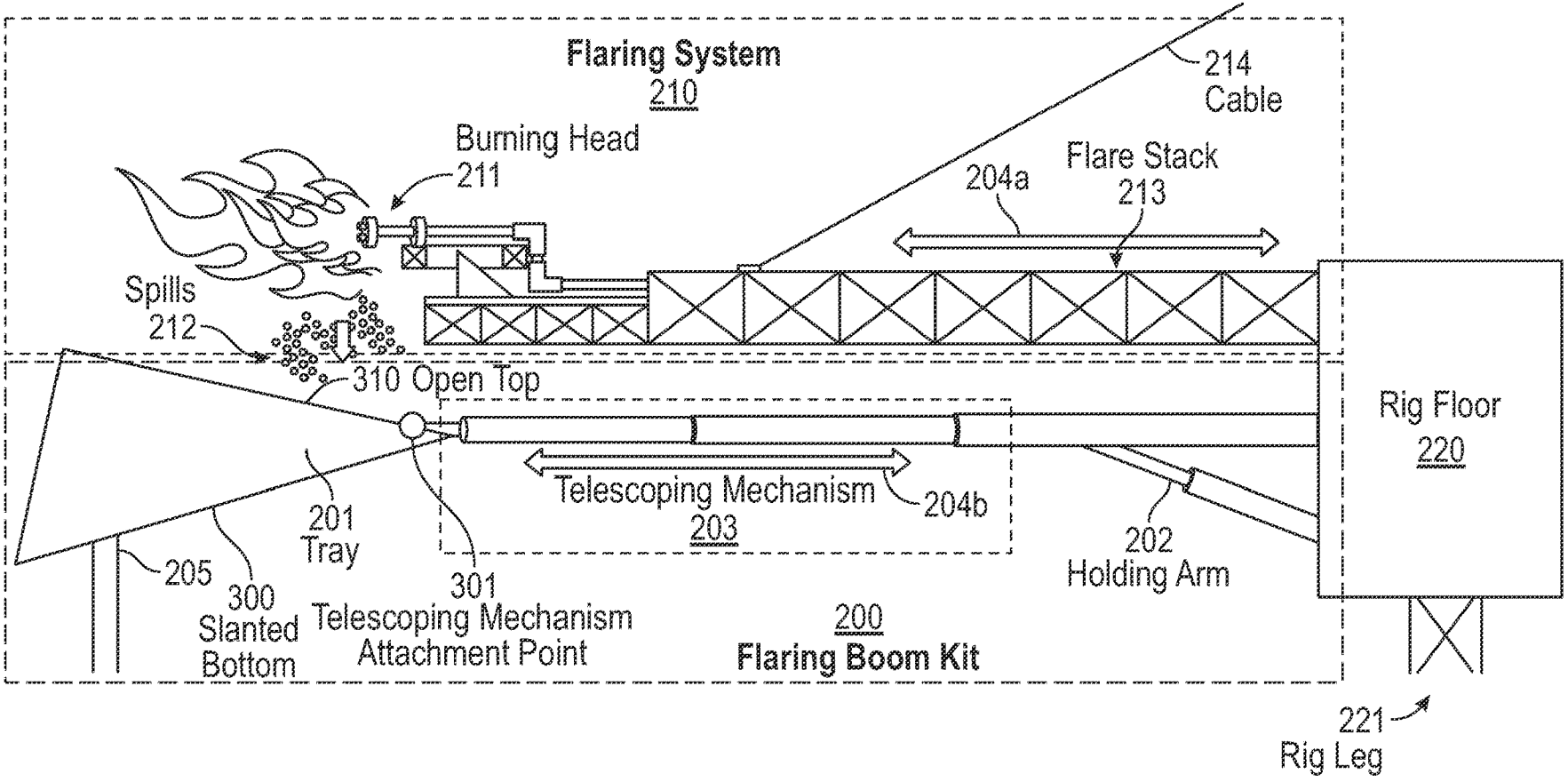
FIG. 2 shows a flaring system and flaring boom kit in accordance with one or more embodiments.

FIG. 2 shows a flaring system and flaring boom kit in accordance with one or more embodiments. In one or more embodiments, one or more of the modules and/or elements shown in FIG. 2 may be omitted, repeated, combined and/or substituted. Accordingly, embodiments disclosed herein should not be considered limited to the specific arrangements of modules and/or elements shown in FIG. 2.

As shown in FIG. 2, a flaring system (210) extends from the rig floor (220) that is supported by the rig leg (221). For example, the rig floor (220) and rig leg (221) may be part of the rig (101) depicted in FIG. 1 above. In particular, the flaring system (210) includes a burning head (211) disposed at one end of the flare stack (213) that is supported by the cable (214). The flare stack (213) and the cable (214) are mechanical structures to position the burning head (211), along a longitudinal direction (204*a*) of the flaring system (210), at a safe distance from the rig floor (220) such that the drilling crew may not be harmed by the flaring operation. During flaring, the burning head (211) allows for the controlled burning of oil and/or natural gas supplied from the wellbore (120) via pipes within the flaring stack (213). Any incomplete burning of the oil and/or natural gas at the burning head (211) creates spills (212), which may include oil spill, waste solid and/or waste fluids that are collected using the flaring boom kit (200).

In one or more embodiments of the invention, the flaring boom kit (200) is an mechanical assembly that includes a tray (201) attached to one end of a telescoping mechanism (203), which has an opposite end attached to the rig floor (220). The tray (201) includes a telescoping mechanism attachment point (301) where the telescoping mechanism (203) is attached. The two ends of the telescoping mechanism (203) defines a longitudinal direction (204*b*) of the flaring boom kit (200). The telescoping mechanism (203) is supported by a holding arm (202) from the rig floor (220) and has a variable length that adjusts the location of the tray (201). Specifically, the telescoping mechanism (203) allows to extend or retract the flaring boom kit (200) along the longitudinal direction (204*b*) for adjusting, e.g., based on the intensity of the controlled burning, the spacing and position of the tray (201) with respect to the burning head (211). As shown in FIG. 2, during the flaring operation, the holding arm (202) is extended to support the telescoping mechanism (203) such that the longitudinal direction (204*b*) of the flaring boom kit (200) and the longitudinal direction (204*a*) of the flaring system (210) are substantially parallel to each other.

The tray (201) is a device that collects the spills (212) resulting from the flaring. The tray (201) has an open top (310), a slanted bottom (300), and an outlet (205). During flaring, the spills (212) fall through the open top (310) onto the slanted bottom (300). In the configuration for performing flaring, the slanted bottom (300) is positioned such that the outlet (205) is at a lower level than a majority (e.g., more than 80%) of the slanted bottom (300). Such position of the slanted bottom (300) allows the collected spills to move along the slanted bottom (300) toward the outlet (205) due to the gravitational force. A tubular line may be connected to the outlet (205) to move the collected spills to storage tanks.

Figure 3:
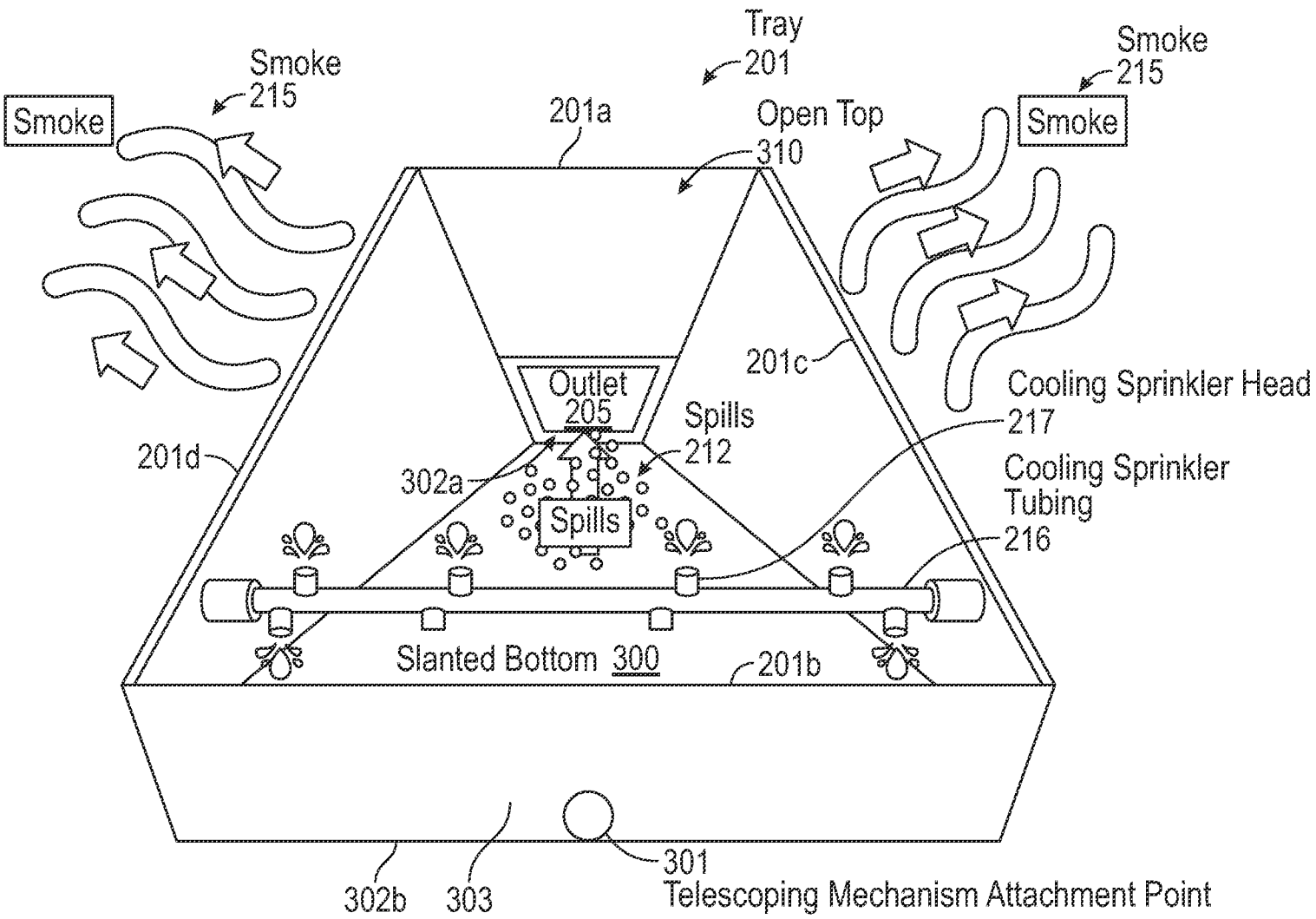
FIGS. 3, 4 and 5 show examples in accordance with one or more embodiments.

FIG. 3 shows an example of the tray (201) depicted in FIG. 2 above. In one or more embodiments, one or more of the modules and/or elements shown in FIG. 3 may be omitted, repeated, combined and/or substituted. Accordingly, embodiments disclosed herein should not be considered limited to the specific arrangements of modules and/or elements shown in FIG. 3.

As shown in FIG. 3, the tray (201) has a funnel shape where four upper edges (201*a*, 201*b*, 201*c*, and 210*d*) of four sides of the tray (201) form the Tim of the open top (310). In particular, the slanted bottom (300) of the tray (201) has a trapezoidal shape. The outlet (205) of the tray (201) abuts the shorter base (302*a*) of the trapezoidal shape and is away from the longer base (302*b*) of the trapezoidal shape. The telescoping mechanism attachment point (301) of the tray (201) is disposed, on the bottom (300) or an adjacent side (303) of the tray (201), closer to the longer base (302*b*) of the trapezoidal shape than the shorter base (302*a*) of the trapezoidal shape. In the example shown in FIG. 3, the shorter base (302*a*) of the trapezoidal shape forms one side of the outlet (205) while the longer base (302*b*) of the trapezoidal shape coincides with the bottom edge of the side (303) of the tray (201). Due to the funnel shape of the tray (201), the collected spills move toward the outlet (205) along the slanted bottom (300) due to the gravitational force. Specifically, the spills (212) and the smoke (215) are generated by the controlled burning at the burning head (211) depicted in FIG. 2 above.

In one or more embodiments, the tray (201) further includes a cooling sprinkler system have a cooling sprinkler tubing (216) supplying cooling fluids (e.g., water) to cooling sprinkler heads (e.g., cooling sprinkler head (217) used for cooling the tray (201). In addition to the gravitational force, the sprayed cooling fluids from the cooling sprinkler heads also exert a hydrodynamic force to facilitate moving the collected spills toward the outlet (205) along the slanted bottom (300).

Although the open top (310) is shown in FIG. 3 as a four-sided polygon defined by the edges (201*a*, 201*b*, 201*c*, 201*d*), the open top (310) may alternatively be implemented as a different polygonal shape, a circular shape, an elliptical shape, etc. Further, although the telescoping mechanism attachment point (301) is shown as disposed at a particular location on the tray (201), the telescoping mechanism attachment point (301) may alternatively be disposed at other locations on the tray (201). In addition, although the outlet (205) is shown as abutted to the shorter base (302*a*), the outlet (205) may alternatively be disposed on other locations of the bottom (300), closer to the shorter base (302*a*) of the trapezoidal shape than the longer base (302*b*)

of the trapezoidal shape. Additional outlet may also be implemented in addition to the outlet (205).

Figure 4:
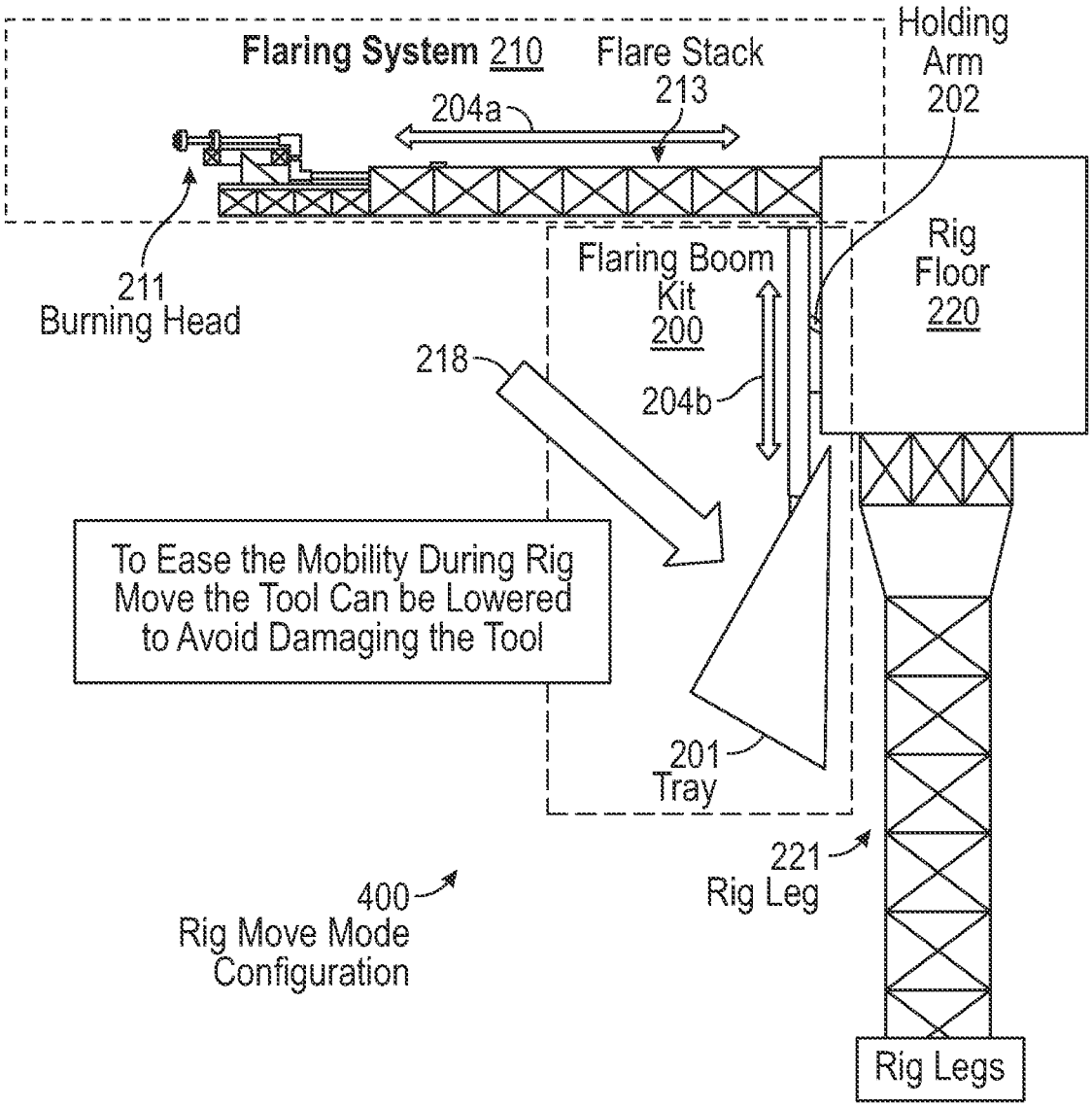

FIG. 4 shows a rig move mode configuration of the flaring boom kit (200) depicted in FIG. 2 above. In one or more embodiments, one or more of the modules and/or elements shown in FIG. 4 may be omitted, repeated, combined and/or substituted. Accordingly, embodiments disclosed herein should not be considered limited to the specific arrangements of modules and/or elements shown in FIG. 4.

As shown in FIG. 4, during re-positioning or any other movement of the rig (101), the holding arm (202) retracts to stow the telescoping mechanism (203) such that the longitudinal direction (204*b*) of the flaring boom kit (200) and the longitudinal direction (204*a*) of the flaring system (210) are substantially perpendicular to each other. Specifically, the longitudinal direction (204*a*) of the flaring system (210) is substantially parallel to the rig leg (221). The rig move mode configuration provides protection to the flaring boom kit (200) against potential vibration, collision and other mechanical damages while the rig floor (220) and rig leg (221) are moving. In particular, the flaring boom kit (200) does not need to be disassembled from the flaring system (210) and/or the rig floor (220) during re-positioning or any other movement of the rig (101).

Figure 5:
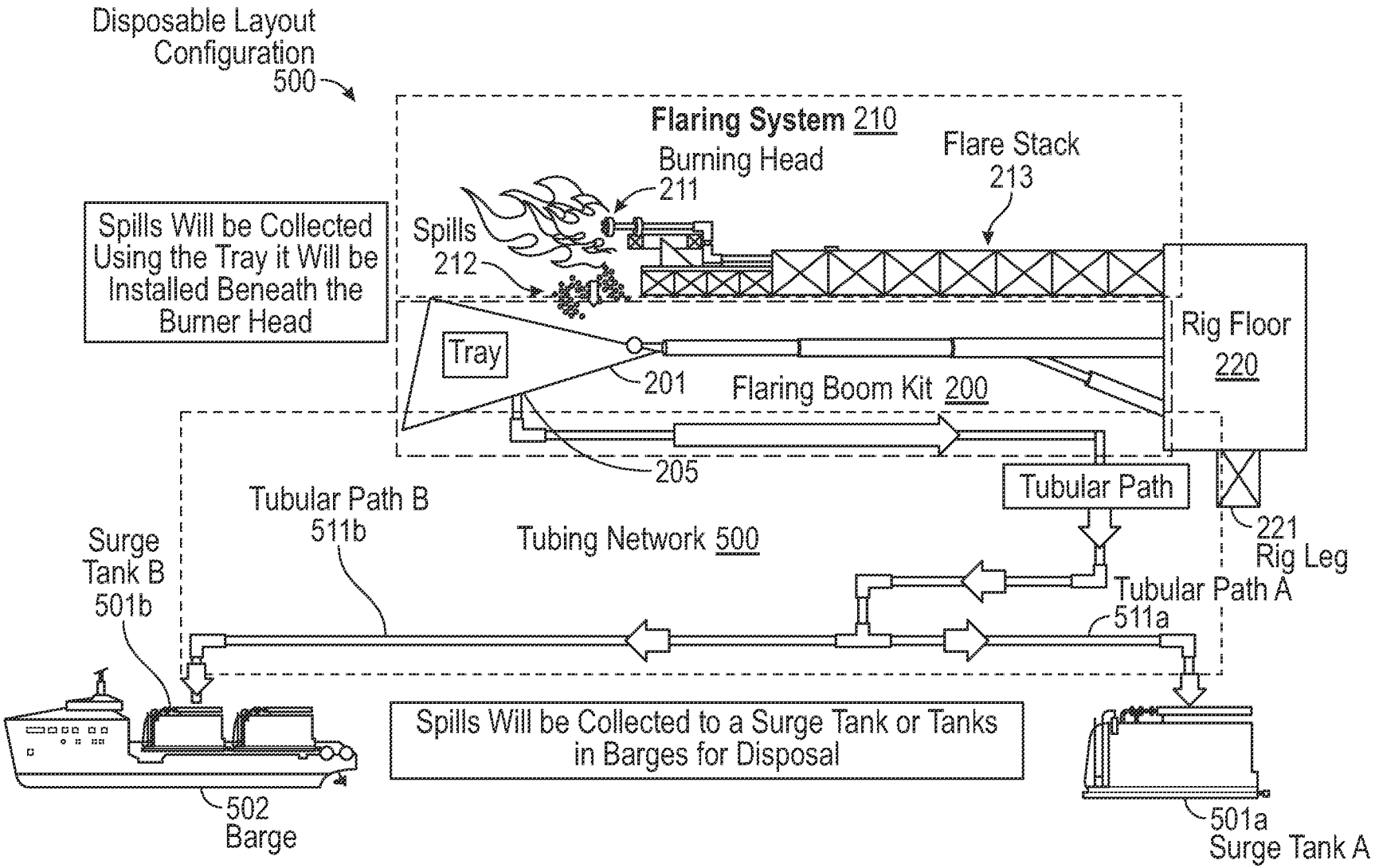

FIG. 5 shows a disposable layout configuration of the flaring boom kit (200) depicted in FIG. 2 above. In one or more embodiments, one or more of the modules and/or elements shown in FIG. 5 may be omitted, repeated, combined and/or substituted. Accordingly, embodiments disclosed herein should not be considered limited to the specific arrangements of modules and/or elements shown in FIG. 5.

As shown in FIG. 5, the disposable layout configuration of the flaring boom kit (200) further includes the tubing network (500) having tubing paths for transporting the collected spills from the outlet (205) of the tray (201) to storage facilities, such as the surge tank A (501*a*), surge tank B (501*b*). In an example scenario, the surge tank A (501*a*) is a land-based storage tank and is particularly suitable if the rig (101) is on land. In this scenario, the surge tank B (501*b*) and the supplying tubing path B (511*b*) may be omitted. In another example scenario, the surge tank B (501*b*) is installed on an offshore vessel such as a barge (502) and is equally suitable if the rig (101) is an off-shore rig or a land-based rig. In this scenario, the surge tank A (501*a*) and the supplying tubing path A (511*a*) may be omitted.

While the disclosure has been described with respect to a limited number of embodiments, those skilled in the art, having benefit of this disclosure, will appreciate that other embodiments can be devised which do not depart from the scope of the disclosure as disclosed herein. Accordingly, the scope of the disclosure should be limited only by the attached claims.

What is claimed is:

1. A flaring boom assembly for a flaring system of a rig, comprising:

a tray device comprising an open top, a slanted bottom, and an outlet;

a telescoping mechanism mechanically coupled to the tray device and configured to adjust a relative position of the tray device with respect to a burning head of the flaring system based on a flaring intensity of the flaring system; and a holding arm configured to support the telescoping mechanism, wherein the holding arm and the telescoping mechanism are anchored on a rig floor of the rig, wherein the holding arm has an adjustable length that defines a variable angle between a first longitudinal direction of the telescoping mechanism and a second longitudinal direction of the flaring system, wherein the holding arm is extended during flaring such that the first longitudinal direction of the telescoping mechanism and the second longitudinal direction of the flaring system are substantially parallel to each other, wherein the holding arm is retracted during relocation of the rig such that the first longitudinal direction of the telescoping mechanism and the second longitudinal direction of the flaring system are substantially perpendicular to each other, and wherein spills of the flaring system fall through the open top onto the slanted bottom and move along the slanted bottom toward the outlet based on a gravitational force.

2. The flaring boom assembly of claim 1, wherein the tray device has a funnel shape with the outlet disposed lower than a majority of the slanted bottom.

3. The flaring boom assembly of claim 1, wherein the slanted bottom has a trapezoidal shape with a shorter base that abuts the outlet.

4. The flaring boom assembly of claim 1, wherein the tray device further comprises a cooling sprinkler configured to spray cooling fluids for cooling the tray device, and wherein the spills of the flaring system move along the slanted bottom toward the outlet further based on a hydrodynamic force exerted by the sprayed cooling fluids.

5. The flaring boom assembly of claim 1, wherein the outlet is connected to a tubing network configured to transport the spills from the tray device to a storage tank, and wherein the rig is a land-based rig and the storage tank is located on land.

6. The flaring boom assembly of claim 1, wherein the outlet is connected to a tubing network configured to transport the spills from the tray device to a storage tank, and wherein the rig is an offshore rig and the storage tank is located on an offshore vessel.

7. A system, comprising:

a rig;

a flaring system of the rig;

a flaring boom assembly, comprising:

a tray device comprising an open top, a slanted bottom, and an outlet; and a telescoping mechanism mechanically coupled to the tray device and configured to adjust a relative position of the tray device with respect to a burning head of the flaring system based on a flaring intensity of the flaring system; and a holding arm configured to support the telescoping mechanism, wherein the holding arm and the telescoping mechanism are anchored on a rig floor of the rig, wherein the holding arm has an adjustable length that defines a variable angle between a first longitudinal direction of the telescoping mechanism and a second longitudinal direction of the flaring system, wherein the holding arm is extended during flaring such that the first longitudinal direction of the telescoping mechanism and the second longitudinal direction of the flaring system are substantially parallel to each other, wherein the holding arm is retracted during relocation of the rig such that the first longitudinal direction of the telescoping mechanism and the second longitudinal direction of the flaring system are substantially perpendicular to each other, and wherein spills of the flaring system fall through the open top onto the slanted bottom and move along the slanted bottom toward the outlet based on a gravitational force.

8. The system of claim 7, wherein the tray device has a funnel shape with the outlet disposed lower than a majority of the slanted bottom.

9. The system of claim 8, wherein the slanted bottom has a trapezoidal shape with a shorter base that abuts the outlet.

10. The system of claim 7, wherein the tray device further comprises a cooling sprinkler configured to spray cooling fluids for cooling the tray device, and wherein the spills of the flaring system move along the slanted bottom toward the outlet further based on a hydrodynamic force exerted by the sprayed cooling fluids.

11. The system of claim 7, wherein the outlet is connected to a tubing network configured to transport the spills from the tray device to a storage tank, and wherein the rig is a land-based rig and the storage tank is located on land.

12. The system of claim 7, wherein the outlet is connected to a tubing network configured to transport the spills from the tray device to a storage tank, and wherein the rig is an offshore rig and the storage tank is located on an offshore vessel.

* * * * *